US012091938B2

(12) United States Patent
Fripp et al.

(10) Patent No.: US 12,091,938 B2
(45) Date of Patent: Sep. 17, 2024

(54) INFLOW CONTROL VALVE HAMMER FOR OVERCOMING SCALE AND STICKING

(71) Applicant: Halliburton Energy Services, Inc., Houston, TX (US)

(72) Inventors: Michael Linley Fripp, Singapore (SG); Mohan Gunasekaran, Singapore (SG); Paul James, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/094,772

(22) Filed: Jan. 9, 2023

(65) Prior Publication Data

US 2024/0229603 A1 Jul. 11, 2024

(51) Int. Cl.
*E21B 34/14* (2006.01)
*E21B 34/06* (2006.01)

(52) U.S. Cl.
CPC ..... *E21B 34/14* (2013.01); *E21B 34/066* (2013.01)

(58) Field of Classification Search
CPC ..... E21B 34/14; E21B 34/142; E21B 34/066
See application file for complete search history.

(56) References Cited

U.S. PATENT DOCUMENTS 3,892,279 A * 7/1975 Amtsberg ..... F03C 1/035 173/127
6,672,565 B2 * 1/2004 Russell ..... F16K 31/56 251/297
2001/0035220 A1 11/2001 Russell
2011/0240299 A1 10/2011 Vick et al.
2020/0123875 A1 4/2020 Alley

FOREIGN PATENT DOCUMENTS

EP 3129582 12/2018
WO 2022197666 9/2022

OTHER PUBLICATIONS

International Search Report and Written Opinion for International Patent Application No. PCT/US2023/013469 dated Sep. 22, 2023.
Denny Adelung, et al., Stuck Pipe, Jars, Jarring and Jar Placement, Oct. 1991.

* cited by examiner

*Primary Examiner* — Catherine Loikith
(74) *Attorney, Agent, or Firm* — Scott Richardson; C. Tumey Law Group, PLLC

(57) ABSTRACT

An inflow control valve hammer system may include a ram disposed adjacent a valve feature, a hammer device configured to drive the ram into the valve feature, and a retention feature configured to hold the hammer device in a loaded position. The retention feature is configured to release the hammer device to impact the ram in response to a threshold force being exerted on the hammer device, and the impact drives the ram to jerk the valve feature. Additionally, the inflow control valve hammer system may include a spring and an actuator. The spring may be disposed adjacent the hammer device. The spring is configured to exert the threshold force on the hammer device in an energized state. Further, the actuator is configured to energize the spring into the energized state.

20 Claims, 6 Drawing Sheets

INFLOW CONTROL VALVE HAMMER FOR OVERCOMING SCALE AND STICKING

BACKGROUND

In the process of completing an oil or gas well, a tubular is run downhole into a wellbore and used to direct produced hydrocarbon fluids from a downhole formation to the surface. In particular, inflow control valves may be disposed along the tubular to permit flow fluid into the tubular in an open position, such that the fluid may flow from the downhole formation to the surface. Further, these inflow control valves may be actuated to closed positions to block fluid flow into the tubular under some conditions. Generally, wellbores may be separated into multiple producing zones via packer assemblies or any suitable sealing mechanism, and at least one inflow control valve may be disposed between packer assemblies. As such, production flow in each zone may be controlled in part by the position (e.g., open, closed, or partially open) of the inflow control valve. Typically, an actuation system is configured to actuate the inflow control valve between positions to control production flow Unfortunately, various conditions (e.g., scale deposition, asphaltene deposition, debris blockage, seals bonding, etc.) may cause the inflow control valve to stick, such that the actuation system may fail to actuate a valve feature (e.g., valve sleeve) of the inflow control valve. Having the inflow control valve stick in an undesired position may hinder production operations. For example, the inflow control valve may be stuck in the closed position, which prevents fluid flow into the tubular via the inflow control valve and reduces overall production from the downhole formation to the surface.

BRIEF DESCRIPTION OF THE DRAWINGS

These drawings illustrate certain aspects of some of the embodiments of the present disclosure and should not be used to limit or define the method.

DETAILED DESCRIPTION

Disclosed herein is an inflow control valve hammer system having various components for impacting a valve feature (e.g., a valve sleeve) of an inflow control valve. Generally, a primary actuation system is configured to actuate the valve sleeve between an open position and a closed position. However, as set forth above, various conditions (e.g., scale deposition, asphaltene deposition, debris blockage, seals bonding, etc.) may cause the valve sleeve to stick, such that the primary actuation system may fail to actuate the valve sleeve. The inflow control hammer is configured to impact the valve sleeve with sufficient force to loosen or unstick the valve sleeve such that the inflow control valve may continue to operate (e.g., shift between the open and closed position) via the primary actuation system. Alternatively, the inflow control valve hammer system may additionally operate as the primary actuation system.

Figure 1:
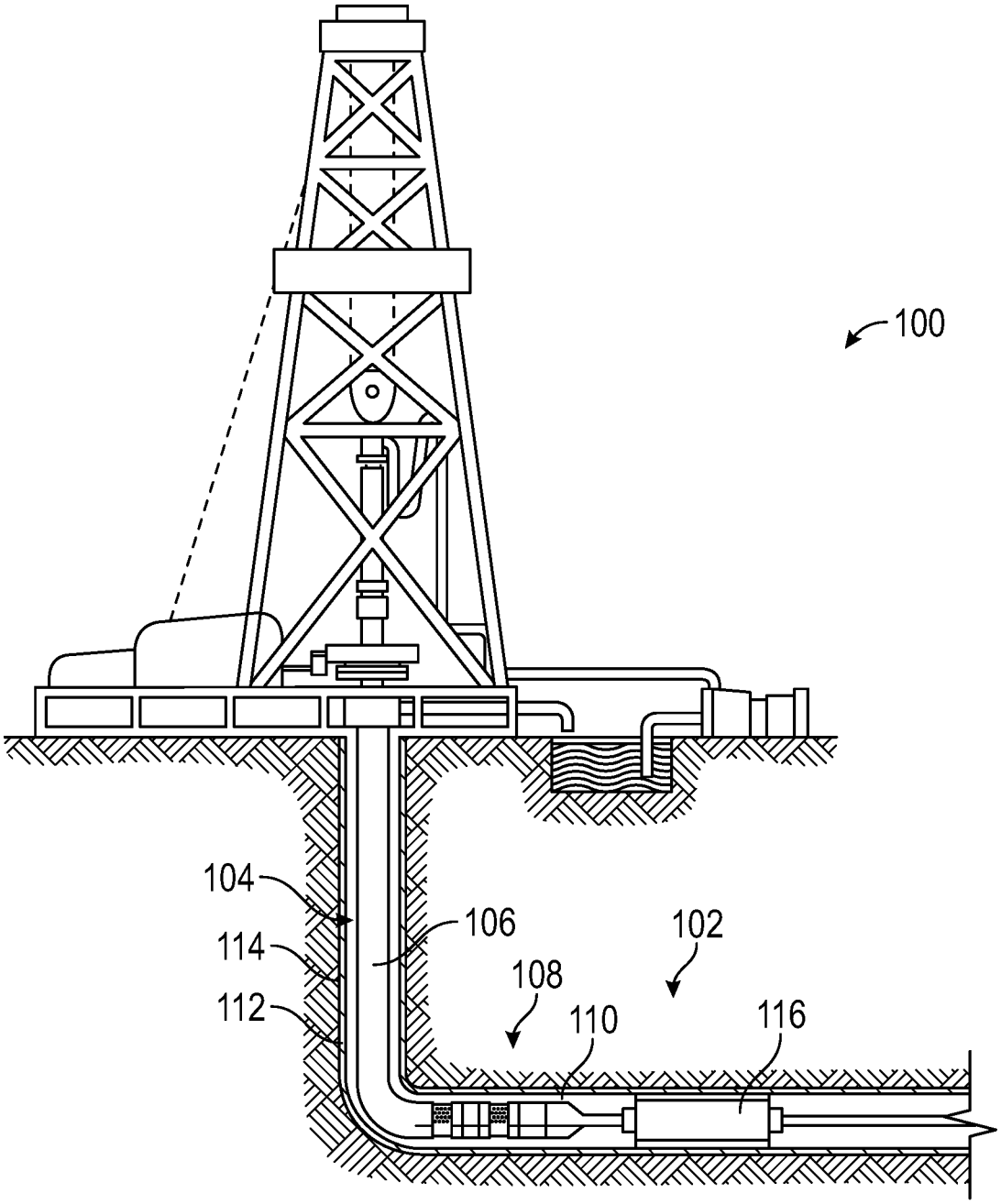
FIG. 1 illustrates an elevation view of a production operation for a wellbore, in accordance with some embodiments of the present disclosure.

FIG. 1 illustrates a side elevation, partial cross-sectional view of an operational environment for a wellbore completion system, in accordance with some embodiments of the present disclosure. As illustrated, the wellbore completion system 100 may include a lower completion assembly 102 that is run into a wellbore 104 via a tubular (e.g., production tubing 106) or other suitable conveyance. The lower completion assembly 102 includes at least one inflow control valve 108 for controlling fluid flow between an annulus 110 of the wellbore 104 and a central bore of the tubular 106. As illustrated, the annulus 110 may be formed between the tubular 106 and a casing 112 cemented to against a wellbore wall 114. In some embodiments, the annulus 110 may be formed between the tubular 106 and the wellbore wall 114. Further, the lower completion assembly 102 may include a packer assembly 116, a latch subassembly, or any other suitable assembly.

Figure 2:
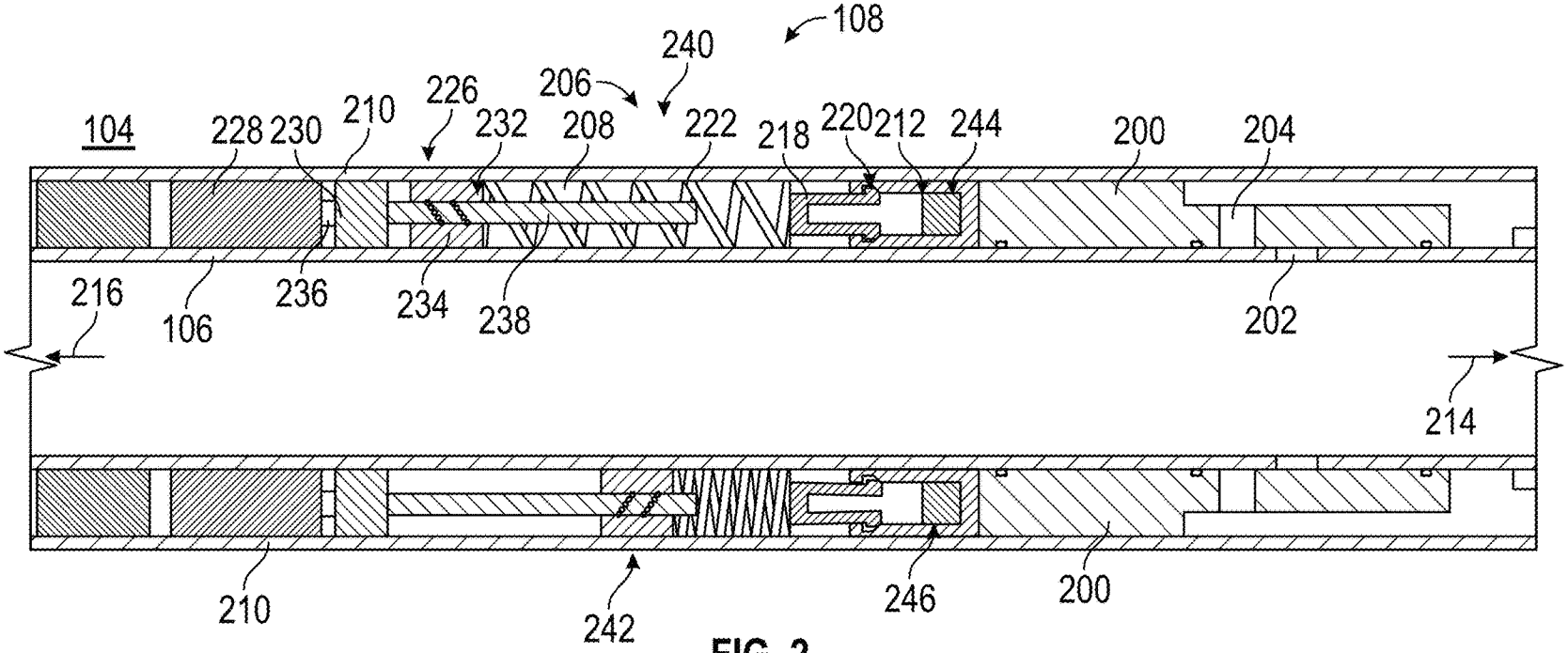
FIG. 2 illustrates a cross-sectional view of an inflow control valve having a plurality of inflow control valve hammer systems, in accordance with some embodiments of the present disclosure.

FIG. 2 illustrates a cross-sectional view of an inflow control valve having a plurality of inflow control valve hammer systems, in accordance with some embodiments of the present disclosure. As illustrated, the inflow control valve 108 may be disposed about a production tubing 106. During production operations, the inflow control valve 108 is configured to transition between a closed state and an open state to control fluid flow from the wellbore 104 into the production tubing 106. Specifically, the inflow control valve 108 comprises a valve feature (e.g., a valve sleeve 200, a piston, a ball, etc.) configured to slide between a closed position and an open position, with respect to the production tubing 106. As illustrated, the production tubing 106 has at least one inlet bore 202 for permitting production fluid to flow into the production tubing 106. Further, the valve sleeve 200 may comprise a fluid passage 204 configured to align with the at least one inlet bore 202 in the open position, such that the production fluid may flow from the wellbore 104 into the production tubing 106. Alternatively, in the open position, the valve sleeve 200 may be axially offset from the at least one inlet bore 202 to allow fluid to flow into the production tubing 106. However, in the closed position, a portion of the valve sleeve 200 may be disposed over the at least one inlet bore 202 to block fluid flow. In the illustrated embodiment, the valve sleeve 200 is disposed in the closed position.

In some embodiments, a primary actuation system (not shown) may be configured to actuate the valve sleeve 200 between the closed position and the open position under normal operating conditions. However, various conditions (e.g., scale deposition, asphaltene deposition, debris blockage, seals bonding, etc.) may cause the valve sleeve 200 to stick, such that the primary actuation system may fail to actuate the valve sleeve 200. As set forth in detail below, the inflow control valve 108 may comprise an inflow control valve hammer system 206 configured to impact the valve sleeve 200 with sufficient force to loosen or unstick the valve sleeve such that the valve sleeve 200 may continue to operate (e.g., shift between the open and closed position).

As illustrated, the inflow control valve hammer system 206 may be disposed within the inflow control valve 108. Specifically, the inflow control valve hammer system 206 may be disposed in a cavity 208 defined between an outer wall 210 of the inflow control valve 108 and the production tubing 106. Moreover, the inflow control valve hammer system 206 includes a ram 212 disposed adjacent the valve sleeve 200. The ram 212 may be configured to slide within the cavity 208 and axially along the production tubing 106 to drive the valve sleeve 200. Further, the ram 212 may be secured to the valve sleeve 200 such that axially downhole and uphole movement of the ram 212 may drive (e.g., push and pull) the valve sleeve 200 to correspondingly move in an axially downhole direction 214 or an axially uphole direction 216. However, in some embodiments, the ram 212 is positioned proximate the valve sleeve 200, but untethered from the valve sleeve 200, such that the ram 212 may only drive (e.g., push) the valve sleeve 200 in a single axial direction along the production tubing 106.

The inflow control valve hammer system 206 further includes a hammer device 218 disposed proximate the ram 212. In some embodiments, the hammer device 218 is at least partially disposed within the ram 212. During operation, the hammer device 218 is configured to impact the ram 212 to drive the ram 212 into the valve sleeve 200. Specifically, the hammer device is held in a loaded position via a retention feature 220 of the inflow control valve hammer system 206. In the loaded position, a spring 222 of the inflow control valve hammer system 206 is configured to apply a biasing force to a base end 224 of the hammer device 218 to drive the hammer device 218 toward the ram 212. However, the retention feature 220 may restrain the hammer device 218 from moving toward the ram 212. The inflow control valve hammer system 206 further includes an actuator 226 configured to energize (e.g., compress) the spring 222 in response to receiving an activation signal. As the spring 222 compresses, the biasing force on the hammer device 218 may increase to a threshold force. The retention feature 220 is configured to release the hammer device 218 upon reaching the threshold force, which may suddenly actuate the hammer device 218 to impact the ram 212. Such impact may drive the ram 212 to impact the valve sleeve 200 to loosen or unstick the valve sleeve 200.

The actuator 226 may comprise an electric motor 228, a gearbox 230, and/or an axial drive mechanism such as a ball-screw mechanism 232 or any suitable linear actuator. As illustrated, the actuator 226 may be disposed within the inflow control valve 108. However, in some embodiments, a portion of the actuator 226 may be disposed exterior to the inflow control valve 108. Moreover, the axial drive mechanism of the actuator 226 may comprise a mover block 234 configured to slide axially along the cavity 208 to compress and/or tension the spring 222. During operation, the motor 228 may activate to turn a driveshaft 236 coupled to the gearbox 230. In response to rotation of the driveshaft 236, the gearbox 230 may rotate to drive a ball-screw 238 of the ball-screw mechanism 232. Further, rotation of the ball-screw 238 in a first direction may drive the mover block 234 axially toward the hammer device 218 to compress the spring 222, and rotation in a second direction may drive the mover block 234 axially away from the hammer device 218 to tension the spring 222.

Moreover, the inflow control valve 108 may comprise a plurality of inflow control valve hammer systems 206. In the illustrated embodiment, the inflow control valve 108 comprises a first control valve hammer system 240 and a second control valve hammer system 242 disposed on opposing sides of the production tubing 106 (e.g., angularly offset by one-hundred and eighty degrees). The first and second control valve hammer systems 240, 242 may simultaneously acuate to uniformly impact the opposing sides of the valve sleeve 200. That is, to cause respective first and second rams 244, 246 to impact the corresponding sides of the valve sleeve 200 at the same time. Alternatively, actuation timings of the first and second control valve hammer systems 240, 242 may be offset to cause the first and second rams 244, 246 to impact the corresponding sides of the valve sleeve 200 at separate times. Moreover, the plurality of inflow control valve hammer systems 206 may include any suitable number of inflow control valve hammer systems 206. In some embodiments, the inflow control valve 108 may comprise an actuation pattern for the plurality of inflow control valve hammer systems 206. For example, the actuation pattern may have the first and second inflow control valve hammer systems 240, 242 actuate simultaneously at a first time (e.g., 0.0 seconds) and then have third and fourth inflow control valve hammer systems (not shown) actuate at a second time (e.g., 2.0 seconds) while the first and second inflow control valve hammer systems 240, 242 reload, such that the first and second inflow control valve hammer systems 240, 242 may again actuate at a third time (e.g., 4.0 seconds) etc. The actuation pattern may include any suitable combinations of actuation timings.

Figure 3A:
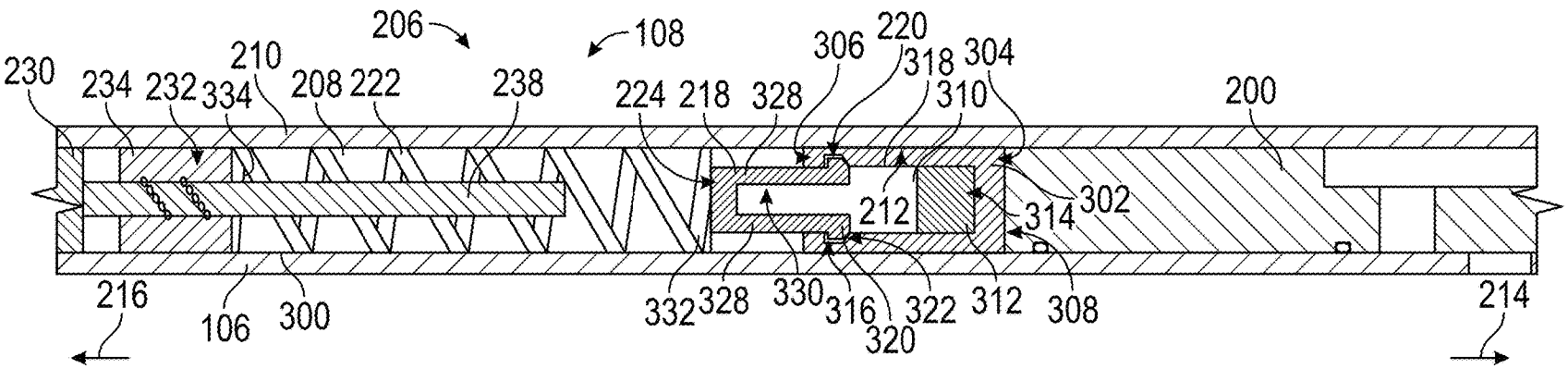
FIGS. 3A-3D illustrate cross-sectional views of the inflow control valve hammer system moving from a loaded position to a released position, in accordance with some embodiments of the present disclosure.

FIGS. 3A-3D illustrate cross-sectional views of the inflow control valve hammer system moving from a loaded position to a released position, in accordance with some embodiments of the present disclosure. In particular, FIG. 3A illustrates a cross-sectional view of the inflow control valve hammer system 206 in the loaded position. Specifically, in the loaded position, the ram 212 may be disposed adjacent the valve sleeve 200 and within the cavity 208 formed between the outer wall 210 of the inflow control valve 108 and an outer surface 300 of the production tubing 106. As set forth above, the ram 212 may be configured to slide from the loaded position to drive (e.g., push and pull) the valve sleeve 200 in an axial direction (e.g., the axially downhole direction 214 or the axially uphole direction 216). In the illustrated embodiment, the ram 212 comprises a main body 302 having a driving end 304 and a receiving end 306. The driving end 304 is configured to interface with a corresponding distal end 308 of the valve sleeve 200. The driving end 304 and the distal end 308 may be oriented orthogonal to an axial direction of the inflow control valve 108 such that a driving force from the ram 212 may be transferred to the valve sleeve 200 via the interface in the axial direction to loosen or unstick the valve sleeve.

Moreover, the ram 212 may have an axial bore 310 extending into the receiving end 306 of the main body 302 of the ram. In the illustrated embodiment, the axial bore 310 extends to an anvil portion in 312 of the ram 212. The anvil portion 312 is configured to receive the impact from the hammer device 218 moving from the loaded position to the released position, which drives the ram 212 axially toward the valve sleeve 200. The anvil portion 312 may comprise a different material than the main body 302. For example, the anvil portion 312 may comprise a first material that is more ductile than a second material of the main body 302 such that the anvil portion 312 may receive the impact from the hammer device 218 with a reduced risk of cracking or otherwise failing. However, the anvil portion 312 may comprise any suitable material. In some embodiments, the anvil portion 312 may comprise a same material as the main body 302. Further, an interface end 314 of the anvil portion 312 may be secured to the main body 302 such that the anvil portion 312 does not move with respect to the main body 302 in response to receiving the impact from the hammer device 218, which may help to avoid energy losses from friction.

In the illustrated embodiment, the retention feature 220 may be disposed within the axial bore 310 that extends into the main body 302 of the ram 212. In particular, the retention feature 220 may comprise at least one recess 316 formed in an interior surface 318 of the main body 302. In the loaded position, the at least one recess 316 is configured to hold at least one radial protrusion 320 of the hammer device 218. Further, an interface 322 between a front edge 324 of the protrusion 320 and an inner surface 326 of the recess 316 may restrain axial movement of the hammer device 218 with respect to the ram 212. In some embodiments, the hammer device 218 may be pre-loaded. However, the interface 322 between the at least one protrusion 320 and the at least one recess 316 may be configured to hold the hammer device 218 in the loaded position up to a threshold force, which is greater than the preload force. Indeed, as set forth in detail below, the retention feature 220 is configured to release the hammer device 218 in response to a threshold force being exerted on the hammer device 218.

Moreover, as illustrated, the hammer device 218 may comprise a collet shape. As such, a portion of the hammer device 218 may be configured to collapse or bend radially inward. Specifically, the hammer device 218 may comprise the base end 224 with at least two arms 328 extending axially outward from the base end 224 and a bending slot 330 disposed radially between the arms 328. Further, the at least one protrusion 320 of the hammer device 218 may be formed on a corresponding arm of the at least two arms 328. However, the hammer device 218 may include any suitable shape. In the loaded position, the arms 328 are configured to extend straight outward in the axially downhole direction 214 (e.g., toward the anvil portion 312 of the ram 212) a radially align the at least one protrusion 320 with the at least one recess 316. Further, the arms 328 may be disposed at least partially within the axial bore 310 of the ram 212 to axially align the at least one protrusion 320 with the corresponding at least one recess 316 of the ram 212 in the loaded position. As such, the at least one protrusion 320 may be disposed within the at least one recess 316 in the loaded position such that the interface 322 between the at least one protrusion 320 and the at least one recess 316 may hold the hammer device 218 in the loaded position. However, as set forth in detail below, the arms 328 may be configured to deflect radially inward into the bending slot 330 to release the hammer device 218. That is, deflecting the arms 328 radially inward may pull the at least one protrusion 320 out of the at least one recess 316 to release the hammer device 218 to move axially to impact the anvil portion 312 of the ram 212.

Further, as set forth above, the inflow control valve hammer system 206 comprises the spring 222 disposed between the hammer device 218 and the actuator 226. In some embodiments, a first end 332 of the spring 222 is disposed adjacent to the base end 224 of the hammer device 218 such that the spring 222 may exert force on the hammer device 218 via an interface between the first end 332 of the spring 222 and the base end 224 of the hammer device 218. In some embodiments, the first end 332 may be coupled to the base end 224 such that the spring 222 may exert force on the hammer device 218 in both axially downhole and uphole directions 214, 216. However, the spring 222 may be positioned and/or secured to the hammer device 218 in any suitable manner that permits the spring 222 to exert axial force on the hammer device 218. The spring 222 may comprise a mechanical spring (e.g., a helical spring, a disc spring, etc.), a hydraulic spring, a gas spring, or any suitable energy storage device.

In the illustrated embodiment, the spring 222 is disposed in a first energized state (e.g., a first compressed state) that is configured to exert a preload force on the hammer device 218. Exerting the preload force on the hammer device 218 is not configured to release the hammer device 218 but may instead be beneficial by reducing a travel distance required to move the spring 222 from the loaded position (e.g., the first compressed state) to a second energized state (e.g., a second compressed state), which is configured to exert the threshold force on the hammer device 218 and release the hammer device 218. Reducing the travel distance required to compress the spring 222 to the second compressed state may reduce a needed travel distance for the actuator 226 to compress the spring 222. As set forth above, the inflow control valve hammer system 206 may be configured to actuate multiple times to loosen or unstick the valve sleeve 200. Thus, reducing the travel distance to compress the spring 222 from the loaded position to the second compressed state and from the released position to the loaded position may decrease downtime between actuations. Alternatively, the spring 222 may be in an uncompressed state in the loaded position.

As set forth above, the actuator 226 is configured to compress the spring 222 from the loaded position (e.g., uncompressed state or first compressed state) to the second compressed state. In the illustrated embodiment, the actuator 226 comprises the ball-screw mechanism 232, which may be driven by the motor 228 and gearbox 230 set forth above. The ball-screw mechanism 232 comprises the mover block 234 and the ball-screw 238. The ball-screw 238 may be coupled to the motor 228 and/or the gearbox 230 such that the motor 228 may drive rotation of the ball-screw 238. Further, the mover block 234 may be interfaced with the ball-screw 238 such that rotation of the ball-screw 238 drives the mover block 234 to slide axially along the cavity 208. Moreover, a second end 334 of the spring 222 may be configured to interface with the mover block 234 such that axial movement of the mover block 234 toward the hammer device 218 may compress the spring 222. In the illustrated embodiment, the mover block 234 is in the loaded position.

Figure 3B:
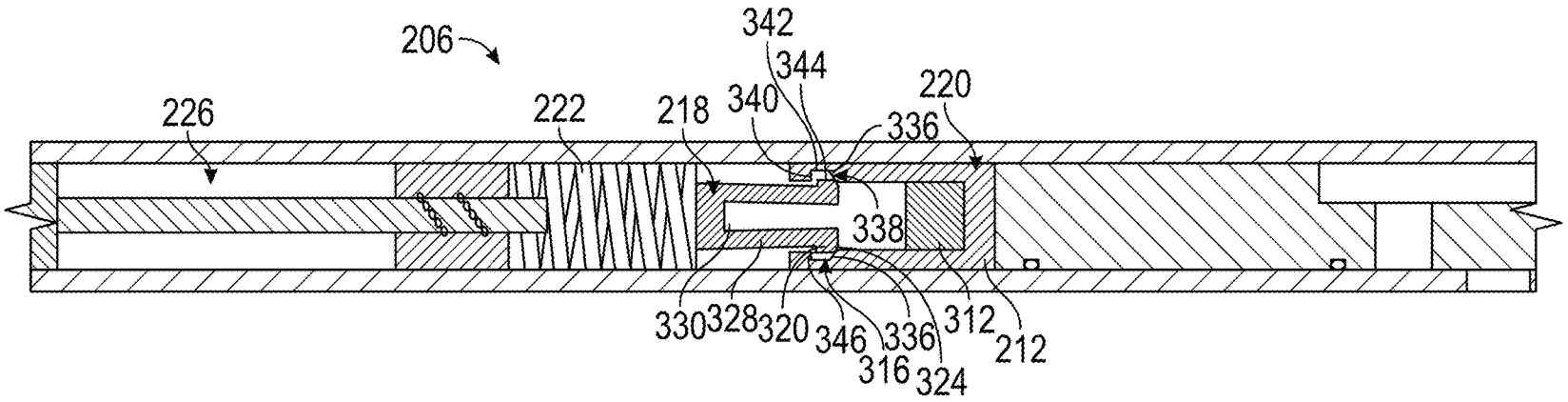

FIG. 3B illustrates cross-sectional views of the inflow control valve hammer system 206 with the spring 222 in a compressed state (e.g., the second compressed state). In some embodiments, the actuator 226 is configured to compress the spring 222 into the second compressed state in response to receiving an actuation signal. Moreover, as set forth above, the spring 222 is configured to exert the threshold force on the hammer device 218 in the second compressed state. Further, the retention feature 220 is configured to release the hammer device 218 in response to the threshold force being exerted on the hammer device 218. Specifically, the threshold force is configured to deflect the arms 328 of the hammer device 218 radially inward into the bending slot 330 a sufficient radial distance to pull the at least one protrusion 320 out of the at least one recess 316, which may release the hammer device 218 to move axially and impact the anvil portion 312 of the ram 212. In the illustrated embodiment, the arms 328 are deflecting radially inward, but the at least protrusion 320 is still partially disposed within the at least one recess 316 to restrain the hammer device 218 from releasing to impact the anvil portion 312.

In the illustrated embodiment, the front edge 324 of the at least protrusion 320 and a front sidewall 336 of the at least one recess 316 are each angled to form a ramped interface 338, which may comprise an angle between thirty to sixty degrees. Specifically, the at least one recess 316 may comprise a rear sidewall 340, an inner wall 342, and the front sidewall 336. The front sidewall 336 may extend radially inward and axially downhole from the inner wall 342 toward the interior surface 318 of the axial bore 310 of the ram 212 at an angle between thirty to sixty degrees. Further, the at least one protrusion 320 may include the front edge 324, an outer edge 344, and a rear edge 346. The front edge 324 may extend radially inward and axially downhole from the outer edge 344 at substantially the same angle as the front sidewall 336.

The threshold force required to release the hammer device 218 may be based at least in part on the angle or slope of the ramped interface 338. Indeed, a greater angle may require more force to bend the arms 328 or the hammer device 218 radially inward. That is, an axial component of the force on the hammer device 218 may drive the hammer device 218 axially toward the at least one recess 316 (e.g., with the at least one protrusion 320 disposed in the at least one recess 316) and a radial component of the force may drive the arm 328 of the hammer device 218 radially inward. Further, a magnitude of the radial component of the force depends on the angle of the ramped interface 338. Increasing the angle may decrease the magnitude of the radial component such that a higher force on the hammer device 218 may be required to bend the arms 328 radially inward and release the hammer device 218. Thus, the threshold force required to release the hammer device 218 may be based at least in part on the angle of the ramped interface 338, as well as a force required to bend the arm 328 a sufficient distance to displace the at least one protrusion 320 from the at least one recess 316.

In the illustrated embodiment, the spring 222 is in the second compressed state to apply the threshold force to the hammer device 218. As such, the radial component of the force is bending the arms 328 of the hammer device 218 radially inward such that the front edge 324 of the at least one protrusion 320 slides axially downhole along the front sidewall 336. Continuing to apply the threshold force to the hammer device 218 may cause the front edge 324 of the at least one protrusion 320 to continue to slide axially downhole along the front sidewall 336 (i.e., as the arms 328 continue to bend radially inward) until the hammer device 218 is released from the at least one recess 316.

Figure 3C:
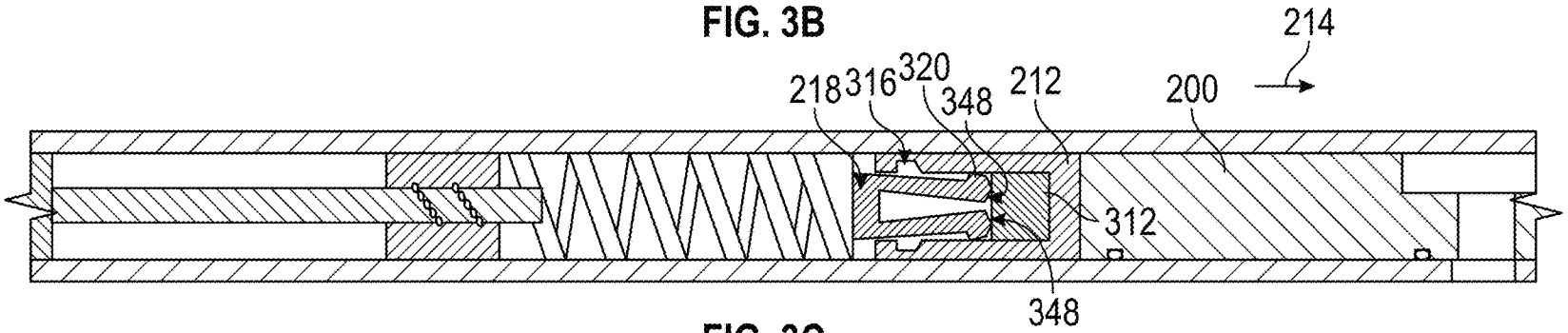

FIG. 3C illustrates cross-sectional views of the inflow control valve hammer system with the hammer device impacting the ram in a released position. As the at least one protrusion 320 of the hammer device 218 slides out of the at least one recess 316, the hammer device 218 may be released to move from the loaded position to the released position. Specifically, the threshold force may suddenly drive the hammer device 218 in the axially downhole direction 214 from the loaded position to impact the anvil portion 312 of the ram 212 in the released position. A contact end 348 of the hammer device (e.g., respective contact ends of the arms 328 of the hammer device 218) may be configured to impact the anvil portion 312 in the released position to transfer an impact force to the ram 212. The impact force may drive the ram 212 into the valve sleeve 200 to loosen or unstick the valve sleeve 200 such that the valve sleeve 200 may move to the open position. In the illustrated embodiment, the valve sleeve 200 is disposed in the open position in response to the ram 212 successfully loosening or unsticking the valve sleeve 200.

Figure 3D:
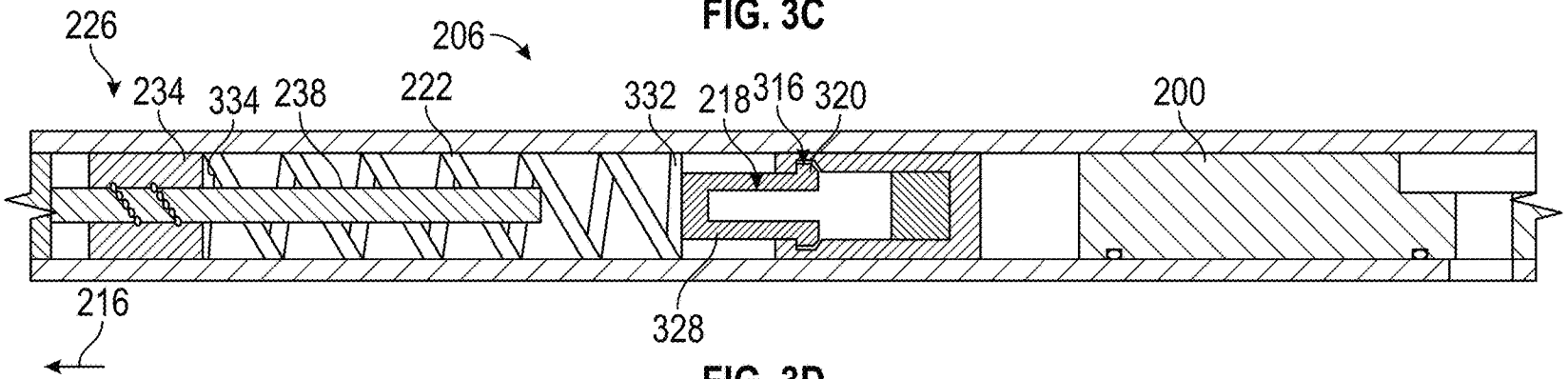

FIG. 3D illustrates cross-sectional views of the inflow control valve hammer system with the actuator reloading the hammer device. As set forth above, the inflow control valve hammer system 206 may be configured to actuate multiple times to loosen or unstick the valve sleeve 200. Thus, as illustrated, inflow control valve hammer system 206 may be configured to reload. That is, the actuator 226 may be configured to rotate the ball-screw 238 in an opposite direction to drive the mover block 234 in the axially uphole direction 216. The spring 222 may decompress in response to axial uphole movement of the mover block 234. Further, the second end 334 of the spring 222 may be secured to the mover block 234 such that the axial uphole movement of the mover block 234 may tension the spring 222. Additionally, the first end 332 of the spring may be secured to the hammer device 218 such that tensioning the spring 222 may pull the hammer device 218 in the axially uphole direction 216 to axially align the at least one protrusion 320 with the at least one recess 316. As illustrated, the arms 328 of the hammer device 218 may deflect radially outward to insert the at least one protrusion 320 into the at least one recess 316 in response to axially aligning the at least one protrusion 320 with the at least one recess 316. Further, with the at least one protrusion 320 disposed in the at least one recess 316, the actuator 226 may reverse rotation of the ball-screw 238 to compress the spring 222 with the preload force into the first compressed state. Moreover, in the first compressed state, the inflow control valve hammer system 206 may again be ready to actuate.

Figure 4A:
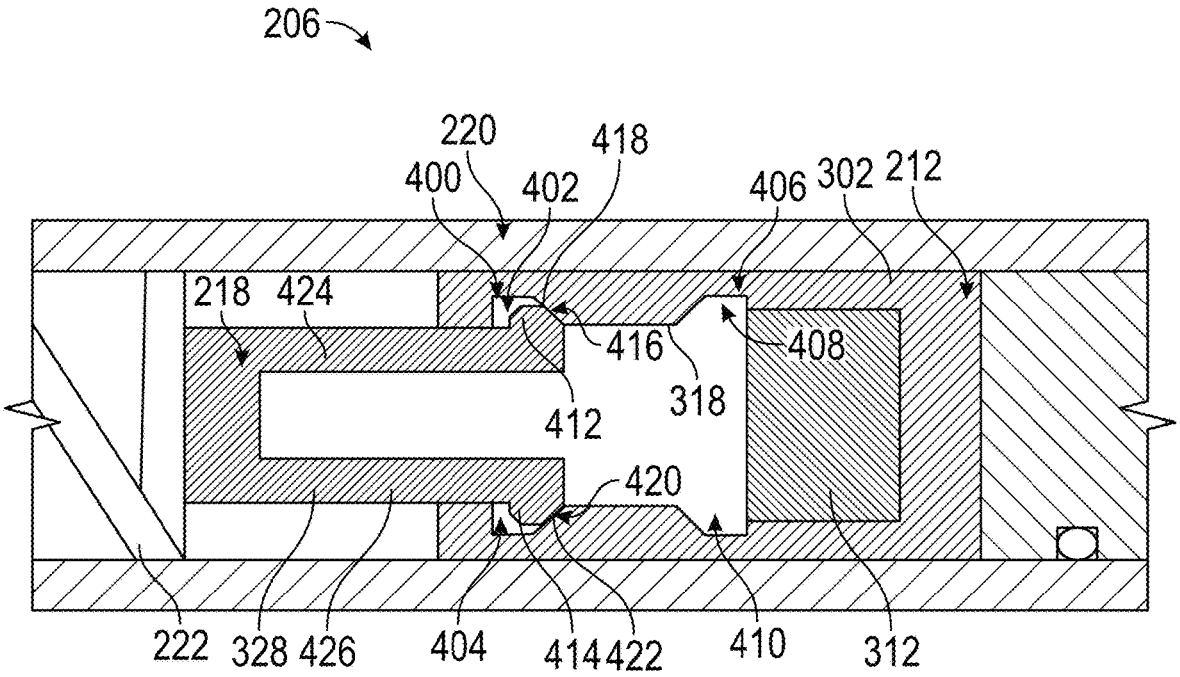
FIGS. 4A-4B illustrate a cross-sectional view of an inflow control valve hammer system with bidirectional operation, in accordance with some embodiments of the present disclosure.
Figure 4B:
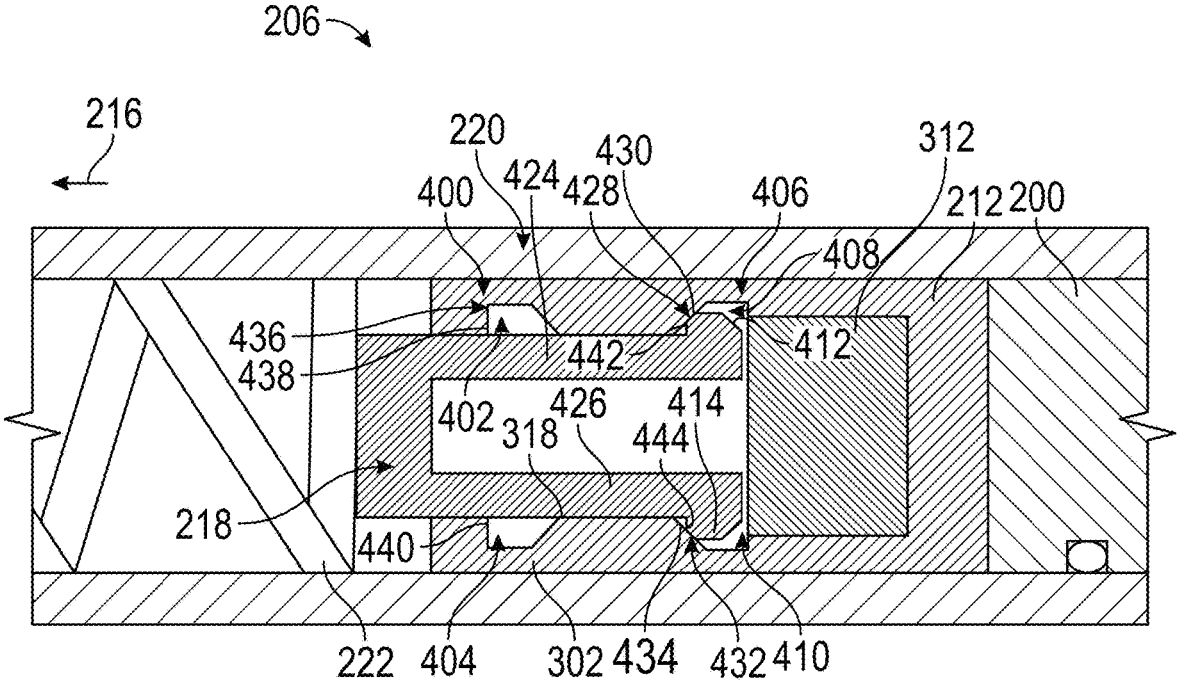

FIGS. 4A-4B illustrates a cross-sectional view of an inflow control valve hammer system with bidirectional operation, in accordance with some embodiments of the present disclosure. As set forth above, the ram may be configured to slide axially to drive (e.g., push and pull) the valve sleeve in an axial direction (e.g., a downhole direction or an uphole direction). In the illustrated embodiments, the ram comprises a retention feature configured to hold the hammer device in a first loaded position or a second loaded position.

In particular, FIG. 4A illustrates a cross-sectional view of the inflow control valve hammer system 206 with the hammer device 218 in the first loaded position for a downhole impact. As illustrated, the retention feature 220 may comprise at least one first recess 400 (e.g., a first outer recess 402 and a first inner recess 404) and at least one second recess 406 (e.g., a second outer recess 408 and a second inner recess 410) formed in the interior surface 318 of the main body 302 of the ram 212. In the first loaded position, the first outer recess 402 and the first inner recess 404 are configured to hold an outer protrusion 412 and an inner protrusion 414, respectively, of the hammer device 218. That is, a first ramped interface 416 between a first front edge 418 of the outer protrusion 412 and the first outer recess 402, as well a second ramped interface 420 between a second front edge 422 of the inner protrusion 414 and the first inner recess 404 are configured to restrain downhole movement of the hammer device 218 with respect to the ram 212. As set forth above, the hammer device 218 may be pre-loaded. However, the first and second interfaces 416, 420 may be configured to hold the hammer device 218 in the first loaded position up to a threshold force, which is greater than the preload force. Indeed, as set forth in detail below, the retention feature 220 is configured to release the hammer device 218 in response to a threshold force being exerted on the hammer device 218.

The first and second ramped interfaces 416, 420 may each comprise an angle between thirty to sixty degrees. The threshold force required to release the hammer device 218 may be based at least in part of the respective angles of the first and second ramped interfaces 416, 420. As set forth above, the magnitude of the radial component of the force, which may drive the arms 328 of the hammer device 218 radially inward, depends on the angles of the first and second ramped interfaces 416, 420. However, in response to the spring 222 applying the threshold force to the hammer device 218, the outer protrusion 412 and the inner protrusion 414 are configured slide axially toward the anvil portion 312 as respective first and second arms 424, 426 of the hammer device 218 deflect radially inward. Once the outer protrusion 412 and the inner protrusion 414 slide out of their respective recesses (e.g., the first outer recess 402 and the first inner recess 404) the threshold force may suddenly drive the hammer device 218 axially downhole from the first loaded position to impact the first anvil portion 312 of the ram 212 in the first released position.

FIG. 4B illustrates cross-sectional views of the inflow control valve hammer system 206 with the hammer device 218 in a second loaded position for an uphole impact. As set forth in greater detail below, releasing the hammer device 218 from the second loaded position may drive the hammer device 218 to impact a second anvil portion 436 of the ram 212, which may drive the ram 212 in the axially uphole direction 216. In the illustrated embodiment, the ram 212 is rigidly secured to the valve sleeve 200. As such, driving the ram 212 in the axially uphole direction 216 may pull the valve sleeve 200 in the axially uphole direction 216 as well. Under some conditions, driving the valve sleeve 200 in the axially uphole direction 216 may further help to loosen or unstick the valve sleeve 200.

Moreover, as set forth above, the retention feature 220 may comprise the at least one first recess 400 (e.g., the first outer recess 402 and the first inner recess 404) and the at least one second recess 406 (e.g., the second outer recess 408 and the second inner recess 410) formed in the interior surface 318 of the main body 302 of the ram 212. As illustrated, the at least one second recess 406 may be disposed axially between the at least one first recess 400 and the anvil portion 312 (e.g., first anvil portion 312). After the inflow control valve hammer system 206 releases the hammer device 218 from the first loaded position to the released position (e.g., first released position), the actuator 226 may be activated to apply tension to the spring 222. As the spring 222 is coupled to the hammer device 218, applying tension to the spring 222 may pull the hammer device 218 in the axially uphole direction 216 to the second loaded position. In the second loaded position, the second outer recess 408 and the second inner recess 410 are configured to hold the outer protrusion 412 and the inner protrusion 414, respectively, of the hammer device 218. That is, a third ramped interface 428 between a first rear edge 430 of the outer protrusion 412 and the second outer recess 408, as well a fourth ramped interface 432 between a second rear edge 434 of the inner protrusion 414 and the second inner recess 410 are configured to restrain uphole movement of the hammer device 218 with respect to the ram 212. However, the third and second ramped interfaces 428, 432 may only be configured to hold the hammer device 218 in the second loaded position up to a second threshold force. That is, in the second loaded position, the retention feature 220 is configured to release the hammer device 218 to move in the axially uphole direction 216 to impact a second anvil portion 436 in response to the second threshold force being exerted on the hammer device 218. The actuator 226 may be configured to tension the spring 222 to a first tensioned state to apply the second threshold force on the hammer device 218.

The second threshold force required to release the hammer device 218 from the second loaded position may be based at least in part of the respective angles of the third and fourth ramped interfaces 428, 432. As set forth above, the magnitude of the radial component of the force, which may drive the arms 328 of the hammer device 218 radially inward, may depend on the respective angles of the third and fourth ramped interfaces 428, 432. However, in response to the spring 222 applying a sufficient second threshold force to the hammer device 218, the outer protrusion 412 and the inner protrusion 414 are configured slide uphole toward the second anvil portion 436 as the respective first and second arms 424, 426 of the hammer device 218 deflect radially inward. Once the outer protrusion 412 and the inner protrusion 414 slide out of their respective recesses (e.g., the second outer recess 408 and the second inner recess 410) the second threshold force may suddenly drive the hammer device 218 in the axially uphole direction 216 from the second loaded position to impact the second anvil portion 436 of the ram 212 in the second released position.

In the illustrated, embodiment, the second anvil portion 436 may comprise a portion of the at least one first recess 400. Specifically, the second anvil portion 436 may comprise an outer rear side wall 438 of the first outer recess 402 and an inner rear sidewall 440 of the first inner recess 404. However, the second anvil portion 436 may comprise any suitable feature coupled to the ram 212 for receiving an uphole impact from the hammer device 218. Further, a first impact shoulder 442 of the first rear edge 430 of the outer protrusion 412 and a second impact shoulder 444 of the second rear edge 434 of the inner protrusion 414 of the hammer device 218 may be configured to impact the second anvil portion 436 (e.g., the outer rear side wall 438 of the first outer recess 402 and the inner rear sidewall 440 of the first inner recess 404) to drive the ram 212 in the axially uphole direction 216, which may pull the valve sleeve 200 in the axially uphole direction 216 to loosen or unstick the valve sleeve 200. As illustrated, the first impact shoulder 442 and the second impact shoulder 444 may comprise vertical angles to help retain the hammer device 218 within the ram 212. That is, the first impact shoulder 442 and the second impact shoulder 444 may prevent axial force on the hammer device 218 from being redirected in the radially inward direction to collapse or bend the hammer device in the radially inward direction, which could release the hammer device to move axially upward and out of the ram.

Figure 5:
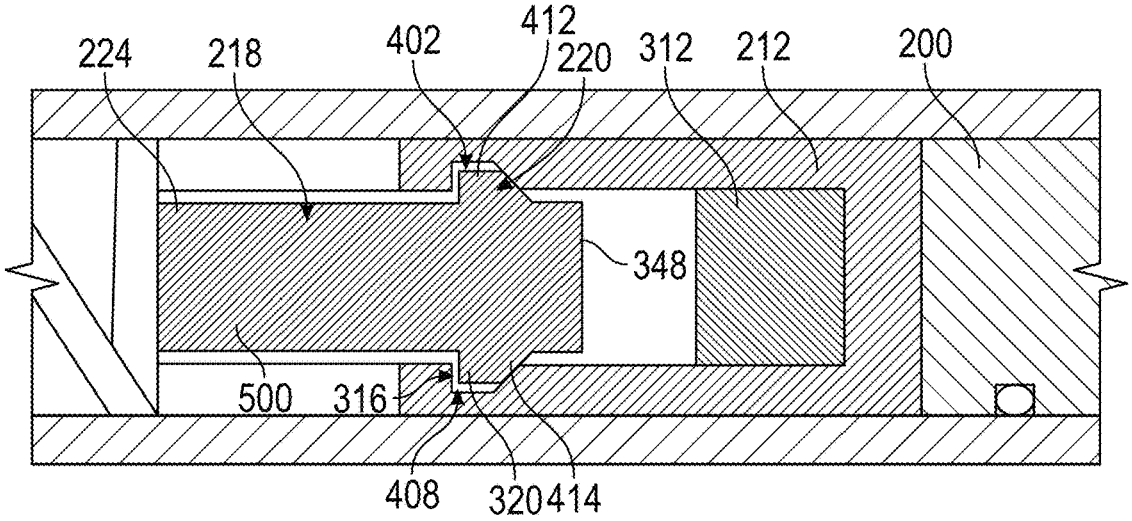
FIG. 5 illustrates a cross-sectional view of an inflow control valve hammer system having a flexible retention feature, in accordance with some embodiments of the present disclosure.

FIG. 5 illustrates a cross-sectional view of an inflow control valve hammer system having a flexible retention feature, in accordance with some embodiments of the present disclosure. As illustrated, the hammer device 218 may comprise the base end 224 and a solid body portion 500 that extends from the base end 224 to the contact end 348 of the hammer device 218. As illustrated, the solid body portion 500 may not comprise a bending slot. As such, the illustrated hammer device 218 (e.g., having the solid body portion 500) may comprise a greater mass than the hammer device 218 comprising the collet shape (shown in FIGS. 3A-D), which may increase an impact force on the anvil portion 312 for driving the ram 212 into the valve sleeve 200. However, as the solid body portion 500 may not deflect radially inward to pull the outer protrusion 412 and the inner protrusion 414 out of the respective outer first recess 402 and first inner recess 408, the retention feature 220 may instead comprise a flexible retention feature.

Specifically, the retention feature 220 may include the at least one protrusion 320 (e.g., the outer protrusion 412 and the inner protrusion 414) having a flexible material. As illustrated, the at least one protrusion 320 is disposed within the at least one recess 316 in the loaded position. However, in response to the threshold force being applied to the hammer device 218, the at least one protrusion 320 is configured deflect (e.g., bend) in a radially inward direction to a position outside of the at least one recess 316, which may release the hammer device 218 from the loaded position to impact the anvil portion 312 of the ram 212.

Figure 6:
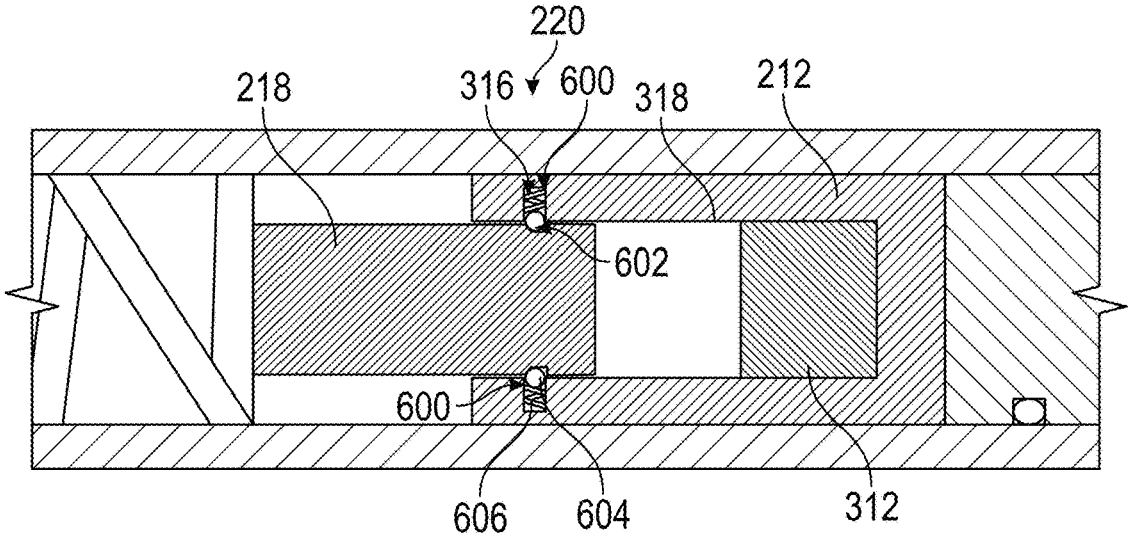
FIG. 6 illustrates a cross-sectional view of an inflow control valve hammer system having a ball detent retention feature, in accordance with some embodiments of the present disclosure.

FIG. 6 illustrates a cross-sectional view of an inflow control valve hammer system having a ball detent retention feature, in accordance with some embodiments of the present disclosure. As illustrated, the retention feature 220 may comprise a ball detent 600 configured to interface with a corresponding hammer recess 602 configured to hold the hammer device 218 in a loaded position. In particular, the at least one recess 316 may be formed in the interior surface 318 of the ram 212. The ball detent 600 may be disposed within the at least one recess 316. The ball detent 600 may comprise a ball 604 and a detent spring 606 configured to bias the ball 604 radially out of the at least one recess. Further, the hammer recess 602 of the hammer device 218 may be configured to receive the ball 604. As illustrated, in the loaded position, the at least one recess 316 of the ram 212 may be axially aligned with the hammer recess 602 such that the detent spring 606 may bias the ball 604 radially outward into the hammer recess 602. The interface between the ball detent 600 and the hammer recess 602 may hold the hammer device 218 in the loaded position via the force applied on the ball 604 from the detent spring 606. However, in response to the threshold force being applied to the hammer device 218, the hammer recess 602 may drive the ball 604 to compress the detent spring 606 and shift the ball 604 out of the hammer recess 602 and into the at least one recess 316; thereby, releasing the hammer device 218 to impact the anvil portion 312 of the ram 212.

Figure 7:
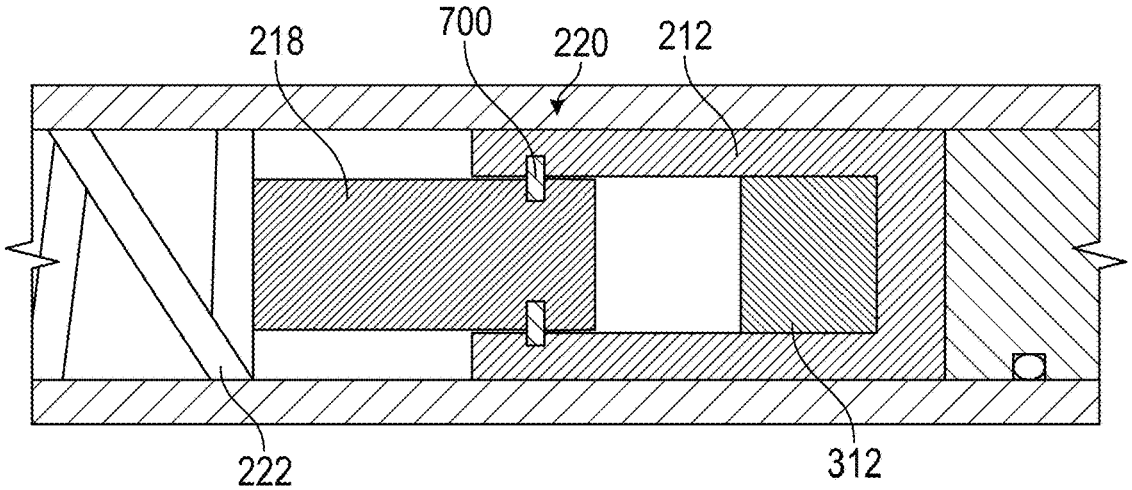
FIG. 7 illustrates a cross-sectional view of an inflow control valve hammer system having a shear pin retention feature, in accordance with some embodiments of the present disclosure.

FIG. 7 illustrates a cross-sectional view of an inflow control valve hammer system having a shear pin retention feature, in accordance with some embodiments of the present disclosure. As illustrated, the retention feature 220 may comprise a shear pin 700 configured to secure the hammer device 218 to the ram 212 in the loaded position. The shear pin 700 may be configured to shear in response to the spring 222 applying the threshold force to the hammer device 218. In response to the shear pin 700 shearing, the hammer device 218 may be released from the loaded position to impact the anvil portion 312 of the ram 212.

Figure 8A:
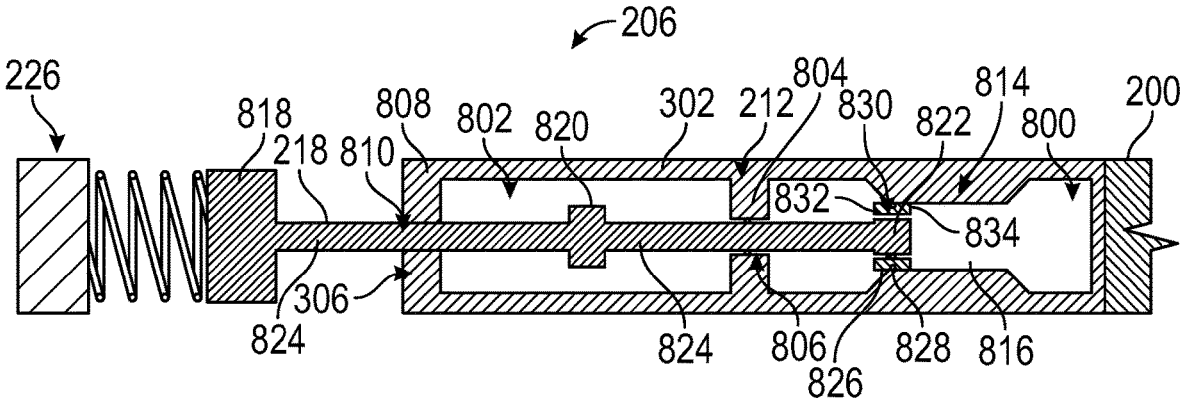
FIGS. 8A-8C illustrate cross-sectional views of the inflow control valve hammer system having a hydraulic retention feature, in accordance with some embodiments of the present disclosure.
Figure 8B:
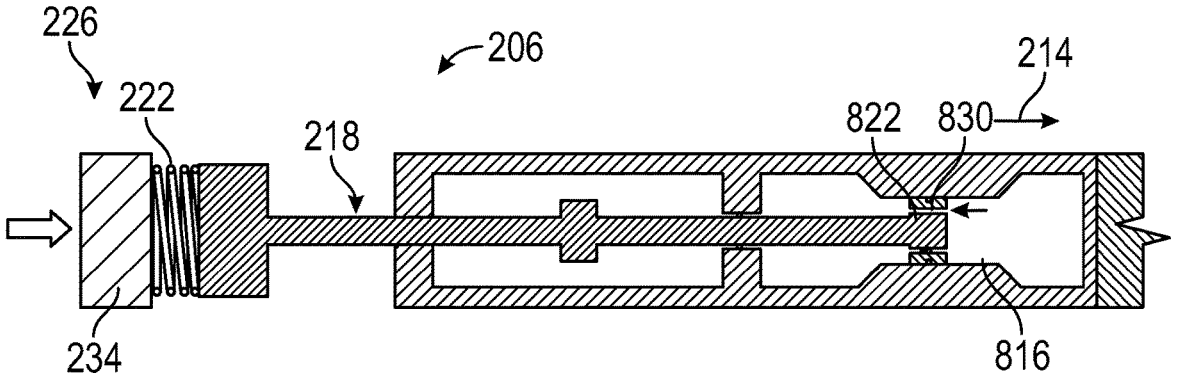
Figure 8C:
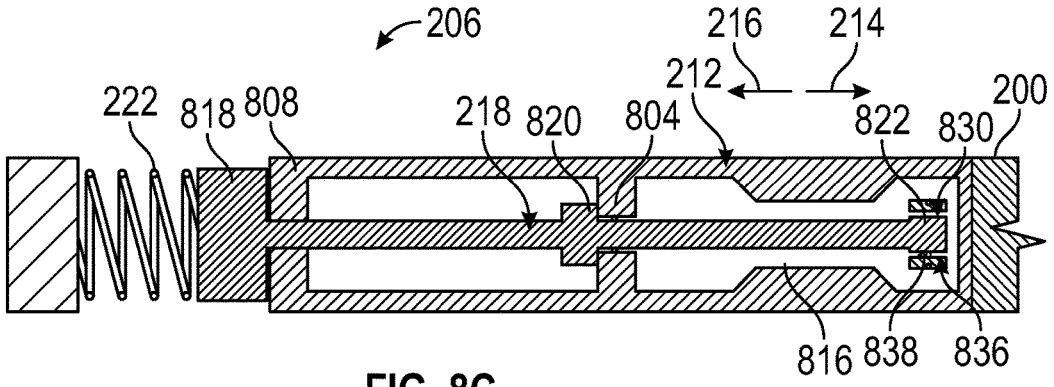

FIGS. 8A-8C illustrate cross-sectional views of the inflow control valve hammer system having a hydraulic retention feature, in accordance with some embodiments of the present disclosure. In particular, FIG. 8A illustrates a cross-sectional view of the inflow control valve hammer system 206 with the hammer device 218 disposed in a loaded position. As set forth above, the ram 212 may be disposed adjacent the valve sleeve 200. Further, the ram 212 may be configured to slide from the loaded position to drive (e.g., push and pull) the valve sleeve 200 in the axial direction to loosen or unstick the valve sleeve 200.

As illustrated, the ram 212 may have a main body 302 with a front internal chamber 800 and a rear internal chamber 802. The front and rear internal chambers 800, 802 may be separated via a front anvil 804. A front axial bore 806 may extend through the front anvil 804 from the front internal chamber 800 to the rear internal chamber 802. Further, the ram 212 may include a rear anvil 808 formed at the receiving end 306 of the main body 302 of the ram 212. A rear axial bore 810 may extend through the rear anvil 808 and into the rear internal chamber 802. Moreover, the hydraulic retention feature 814 may be disposed within the front internal chamber 800. The hydraulic retention feature 814 may comprise a seal bore 816 formed from a reduced diameter portion of the front internal chamber 800.

Further, the hammer device 218 may be disposed within at least partially within the main body 302 of the ram 212. The hammer device 218 comprises a rear hammer portion 818, a front hammer portion 820, and a piston 822, that are each secured to a main rod 824. As illustrated, the main rod 824 may extend through the front axial bore 806 and the rear axial bore 810 such that the piston 822 may be disposed within the front internal chamber 800, the front hammer portion 820 may be disposed within the rear internal chamber 802, and the rear hammer portion 818 may be disposed in the cavity 208 between the ram 212 and the actuator 226. Specifically, in the illustrated embodiment, the piston 822 is at least partially disposed within the seal bore 816. A radially outer surface 826 of the piston 822 may have a substantially similar diameter to the diameter of the seal bore 816 to limit an amount of fluid that may pass between the piston 822 and the seal bore 816. In some embodiments, the piston 822 may comprise a seal 828 configured to prevent fluid from passing between the piston 822 and the seal bore 816 as the piston 822 move with respect to the seal bore 816. As the front internal chamber 800 and the rear internal chamber 802 are filled with fluid, the piston 822 may comprise at least one bypass bore 830 (e.g., a metering nozzle) extending from a leading surface 832 of the piston 822 to a trailing surface 834 of the piston 822. The at least one bypass bore 830 permits fluid to pass through the piston 822 as the piston 822 moves axially along the seal bore 816. However, the at least one bypass bore 830 be sized (e.g., diameter) to restrict the speed of the piston 822 moving through the seal bore 816, which may build force as the piston 822 moves through the seal bore 816.

FIG. 8B illustrates cross-sectional views of the inflow control valve hammer system 206 with the spring 222 in an energized state. As illustrated, the actuator 226 is configured to drive the mover block 234 toward the hammer device 218, which also drives the spring 222 toward into hammer device 218. The force from the spring 222 on the hammer device 218 may drive the piston 822 in the axially downhole direction 214 through the seal bore 816. However, as the least one bypass bore 830 is configured to restrict the speed of the piston 822 moving through the seal bore 816, the spring 222 may energize (e.g., compress) as the piston 822 moves through the seal bore 816.

FIG. 8C illustrates cross-sectional views of the inflow control valve hammer system 206 in a released state. In response to the piston 822 exiting the seal bore 816, the hammer device 218 is configured to suddenly accelerate in the axially downhole direction 214 due to the energy release from the spring 222 since the speed the piston 822 is no longer restrained by the seal bore 816. The sudden acceleration of the hammer device 218 may drive the front hammer portion 820 to impact the front anvil 804, the rear hammer portion 818 to impact the rear anvil 808, or some combination thereof. Such impact may drive the ram 212 into the valve sleeve 200 to loosen or unstick the valve sleeve 200.

Further, the piston 822 may comprise a second bypass bore 836 (e.g., a second metering nozzle), which includes a check valve 838. The check valve 838 may be configured to block flow through the second bypass bore 836 as the piston 822 moves in the axially downhole direction 214. However, the check valve 838 may be configured to permit fluid flow through the second bypass bore 836 as the piston 822 moves in the axially uphole direction 216. As such, the piston 822 may be pulled through the seal bore 816 in the axially uphole direction 216 with less force than the piston 822 moving in the axially downhole direction 214 since there are at least two open bypass bores 830, 836 for the fluid to pass through the piston 822 with the piston 822 moving in the uphole direction 216.

Moreover, as set forth above, the inflow control valve hammer system 206 is generally configured to impact the valve feature of an inflow control valve 108 to loosen or unstick the valve feature such that the inflow control valve 108 may continue to operate (e.g., shift between the open and closed position) via the primary actuation system. However, the inflow control valve hammer system 206 may be used in combination with any suitable downhole valve system. For example, in some embodiments, the inflow control valve hammer system 206 may be configured to impact a valve feature of an injection valve.

Accordingly, the present disclosure may provide inflow control valve hammer systems for loosening or unsticking a valve sleeve of an inflow control valve. The systems may include any of the various features disclosed herein, including one or more of the following statements.

Statement 1. An inflow control valve hammer system, comprising: a ram disposed adjacent a valve feature; a hammer device configured to drive the ram into the valve feature; a retention feature configured to hold the hammer device in a loaded position, wherein the retention feature is configured to release the hammer device to impact the ram in response to a threshold force being exerted on the hammer device, wherein the impact drives the ram to jerk the valve feature; a spring disposed adjacent the hammer device, wherein the spring is configured to exert the threshold force on the hammer device in an energized state; and an actuator configured to energize the spring into the energized state.

Statement 2. The system of statement 1, wherein the hammer device comprises a collet having at least one radial protrusion, wherein the retention feature comprises at least one corresponding recess formed in the ram, and wherein contact between a front edge of the at least one radial protrusion and a sidewall of the at least one corresponding recess is configured to hold the hammer device in the loaded position.

Statement 3. The system of statement 2, wherein the front edge and the sidewall are each angled to form a ramped interface, wherein the threshold force on the hammer device is configured to compress the collet radially inward as the front edge slides axially along the sidewall to move the at least one radially protrusion out of the at least one corresponding recess and release the hammer device from the loaded position.

Statement 4. The system of statement 3, wherein the ramped interface comprises an angle between twenty and seventy degrees.

Statement 5. The system of any of statements 2-4, wherein the at least one radial protrusion comprises a flexible material, and wherein the threshold force on the hammer device is configured to bend the at least one radial protrusion out of the at least one corresponding recess to release the hammer device from the loaded position.

Statement 6. The system of any of statements 2-5, wherein the retention feature further comprises at least one second recess formed in the ram, wherein the at least one second recess is configured to interface with a rear edge of the at least one radial protrusion to restrain movement of the hammer device in an axially uphole direction.

Statement 7. The system of any preceding statement, wherein the retention feature comprises a shear pin configured to secure the hammer device to the ram in the loaded position.

Statement 8. The system of any preceding statement, wherein the retention feature comprises a ball detent configured to interface with a corresponding recess to hold the hammer device in a loaded position.

Statement 9. The system of any preceding statement, wherein the ram is disposed in a cavity formed between a tubing and an outer wall of the inflow control valve, wherein the ram is configured to slide axially along the cavity.

Statement 10. The system of any preceding statement, wherein the actuator is configured to compress the spring into a preloaded state, wherein the spring in the preloaded state is configured to hold the hammer device in the loaded position, and wherein the actuator is configured to further compress the spring into the energized state in response to receiving an actuation signal.

Statement 11. The system of any preceding statement, wherein the actuator comprises an electric motor and an axial drive mechanism, and wherein the axial drive mechanism comprises a ball screw mechanism.

Statement 12. The system of statement 11, wherein the spring is disposed between the hammer device and a mover block of the ball screw mechanism.

Statement 13. The system of any preceding statement, wherein the actuator is disposed in the inflow control valve.

Statement 14. The system of any preceding statement, wherein the spring comprises a mechanical spring, a hydraulic spring, a gas spring, or some combination thereof.

Statement 15. An inflow control valve hammer system, comprising: a ram disposed adjacent a valve feature, wherein the ram comprises an axial bore extending into the ram to an anvil portion of the ram; a hammer device disposed at least partially within the axial bore of the ram, wherein the hammer device is configured to move along the axial bore from a loaded position to a released position to impact the anvil portion, wherein the impact drives the ram to jerk the valve feature; a retention feature configured to hold the hammer device in a loaded position, wherein the retention feature is configured to release the hammer device in response to a threshold force being exerted on the hammer device; a spring disposed adjacent the hammer device, wherein the spring is configured to exert the threshold force on the hammer device in an energized state; and an actuator configured to compress the spring into the energized state.

Statement 16. The system of statement 15, wherein the hammer device comprises a collet having a radial protrusion, wherein the retention feature comprises a first recess formed in an interior surface of ram defined by the axial bore, and wherein contact between a front edge of the radial protrusion and a first sidewall of the first recess is configured to restrain axially downhole movement of the hammer device to hold the hammer device in the loaded position.

Statement 17. The system of statement 16, wherein the front edge and the first sidewall are each angled to form a first ramped interface, wherein the threshold force on the hammer device is configured to compress the collet radially inward as the front edge slides axially along the first sidewall to move the radial protrusion out of the first recess and release the hammer device from the loaded position to move axially downhole and impact the anvil portion.

Statement 18. The system of statement 17, wherein the ram is rigidly secured to the valve feature, wherein the retention feature further comprises a second recess formed in the interior surface of ram defined by the axial bore, wherein the second recess is disposed axially between the first recess and the anvil portion, wherein a rear edge of the radial protrusion contacts a second sidewall of the second recess at a second ramped interface to restrain axially uphole movement of the hammer device, wherein the actuator is configured to pull the spring to exert a second threshold force on the hammer device, wherein the second threshold force is configured to compress the collet radially inward as the rear edge slides axially along the second sidewall to move the radial protrusion out of the second recess and release the hammer device to move axially uphole and impact a second anvil portion.

Statement 19. A method for actuating an inflow control valve hammer system, comprising: preloading a hammer device against a retention feature via a spring, wherein the retention feature is configured to hold the hammer device in a loaded position, and wherein the retention feature is configured to release the hammer device to impact a ram in response to a threshold force being exerted on the hammer device, and wherein the impact drives the ram into a valve feature to jar the valve feature; compressing the spring to a compressed state via an actuator, wherein the spring is configured to exert the threshold force on the hammer device in an energized state; impacting the ram with the hammer device released from the loaded position; and reloading the hammer device via the actuator tensioning the spring.

Statement 20. The method of statement 19, wherein the actuator comprises an electrical motor and an axial drive mechanism disposed within an inflow control valve, and wherein the axial drive mechanism comprises a ball screw mechanism.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. An inflow control valve hammer system, comprising:

a ram disposed adjacent a valve feature;

a hammer device configured to drive the ram into the valve feature;

a retention feature configured to hold the hammer device in a loaded position, wherein the retention feature is configured to release the hammer device to impact the ram in response to a threshold force being exerted on the hammer device, wherein the impact drives the ram to jerk the valve feature;

a spring disposed adjacent the hammer device, wherein the spring is configured to exert the threshold force on the hammer device in an energized state; and an actuator configured to energize the spring into the energized state.

2. The system of claim 1, wherein the hammer device comprises a collet having at least one radial protrusion, wherein the retention feature comprises at least one corresponding recess formed in the ram, and wherein contact between a front edge of the at least one radial protrusion and a sidewall of the at least one corresponding recess is configured to hold the hammer device in the loaded position.

3. The system of claim 2, wherein the front edge and the sidewall are each angled to form a ramped interface, wherein the threshold force on the hammer device is configured to compress the collet radially inward as the front edge slides axially along the sidewall to move the at least one radially protrusion out of the at least one corresponding recess and release the hammer device from the loaded position.

4. The system of claim 3, wherein the ramped interface comprises an angle between twenty and seventy degrees.

5. The system of claim 2, wherein the at least one radial protrusion comprises a flexible material, and wherein the threshold force on the hammer device is configured to bend the at least one radial protrusion out of the at least one corresponding recess to release the hammer device from the loaded position.

6. The system of claim 2, wherein the retention feature further comprises at least one second recess formed in the ram, wherein the at least one second recess is configured to interface with a rear edge of the at least one radial protrusion to restrain movement of the hammer device in an axially uphole direction.

7. The system of claim 1, wherein the retention feature comprises a shear pin configured to secure the hammer device to the ram in the loaded position.

8. The system of claim 1, wherein the retention feature comprises a ball detent configured to interface with a corresponding recess to hold the hammer device in a loaded position.

9. The system of claim 1, wherein the ram is disposed in a cavity formed between a tubing and an outer wall of an inflow control valve, wherein the ram is configured to slide axially along the cavity.

10. The system of claim 1, wherein the actuator is configured to compress the spring into a preloaded state, wherein the spring in the preloaded state is configured to hold the hammer device in the loaded position, and wherein the actuator is configured to further compress the spring into the energized state in response to receiving an actuation signal.

11. The system of claim 1, wherein the actuator comprises an electric motor and an axial drive mechanism, and wherein the axial drive mechanism comprises a ball screw mechanism.

12. The system of claim 11, wherein the spring is disposed between the hammer device and a mover block of the ball screw mechanism.

13. The system of claim 1, wherein the actuator is disposed in an inflow control valve.

14. The system of claim 1, wherein the spring comprises a mechanical spring, a hydraulic spring, a gas spring, or some combination thereof.

15. An inflow control valve hammer system, comprising:

a ram disposed adjacent a valve feature, wherein the ram comprises an axial bore extending into the ram to an anvil portion of the ram;

a hammer device disposed at least partially within the axial bore of the ram, wherein the hammer device is configured to move along the axial bore from a loaded position to a released position to impact the anvil portion, wherein the impact drives the ram to jerk the valve feature;

a retention feature configured to hold the hammer device in the loaded position, wherein the retention feature is configured to release the hammer device in response to a threshold force being exerted on the hammer device;

a spring disposed adjacent the hammer device, wherein the spring is configured to exert the threshold force on the hammer device in an energized state; and an actuator configured to compress the spring into the energized state.

16. The system of claim 15, wherein the hammer device comprises a collet having a radial protrusion, wherein the retention feature comprises a first recess formed in an interior surface of ram defined by the axial bore, and wherein contact between a front edge of the radial protrusion and a first sidewall of the first recess is configured to restrain axially downhole movement of the hammer device to hold the hammer device in the loaded position.

17. The system of claim 16, wherein the front edge and the first sidewall are each angled to form a first ramped interface, wherein the threshold force on the hammer device is configured to compress the collet radially inward as the front edge slides axially along the first sidewall to move the radial protrusion out of the first recess and release the hammer device from the loaded position to move axially downhole and impact the anvil portion.

18. The system of claim 17, wherein the ram is rigidly secured to the valve feature, wherein the retention feature further comprises a second recess formed in the interior surface of ram defined by the axial bore, wherein the second recess is disposed axially between the first recess and the anvil portion, wherein a rear edge of the radial protrusion contacts a second sidewall of the second recess at a second ramped interface to restrain axially uphole movement of the hammer device, wherein the actuator is configured to pull the spring to exert a second threshold force on the hammer device, wherein the second threshold force is configured to compress the collet radially inward as the rear edge slides axially along the second sidewall to move the radial protrusion out of the second recess and release the hammer device to move axially uphole and impact a second anvil portion.

19. A method for actuating an inflow control valve hammer system, comprising:

preloading a hammer device against a retention feature via a spring, wherein the retention feature is configured to hold the hammer device in a loaded position, and wherein the retention feature is configured to release the hammer device to impact a ram in response to a threshold force being exerted on the hammer device, and wherein the impact drives the ram into a valve feature to jar the valve feature;

compressing the spring to a compressed state via an actuator, wherein the spring is configured to exert the threshold force on the hammer device in an energized state;

impacting the ram with the hammer device released from the loaded position; and reloading the hammer device via the actuator tensioning the spring.

20. The method of claim 19, wherein the actuator comprises an electrical motor and an axial drive mechanism disposed within an inflow control valve, and wherein the axial drive mechanism comprises a ball screw mechanism.

* * * * *